US007090141B2

(12) United States Patent
Roh et al.

(10) Patent No.: US 7,090,141 B2
(45) Date of Patent: Aug. 15, 2006

(54) NETWORKING SYSTEM OF REFRIGERATOR AND METHOD FOR OPERATING THE SAME

(75) Inventors: Young Hoon Roh, Seoul (KR); Ik Kyu Lee, Changwon-si (KR); Sang Mahn Kim, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 78 days.

(21) Appl. No.: 10/795,583

(22) Filed: Mar. 9, 2004

(65) Prior Publication Data

US 2004/0186596 A1 Sep. 23, 2004

(30) Foreign Application Priority Data

Mar. 10, 2003 (KR) ..... P10-2003-0014897
Mar. 10, 2003 (KR) ..... P10-2003-0014898

(51) Int. Cl.

| | |
|---|---|
| ***G05D 23/00*** | (2006.01) |
| ***G01K 13/00*** | (2006.01) |
| ***G08B 17/00*** | (2006.01) |
| ***G01M 1/38*** | (2006.01) |

(52) U.S. Cl. ..... 236/51; 62/129; 340/585; 700/276

(58) Field of Classification Search ..... 236/51, 236/94; 62/125, 126, 127, 129; 165/11.1; 340/870.17, 584, 585; 700/275, 276
See application file for complete search history.

(56) References Cited

U.S. PATENT DOCUMENTS

| | | | | |
|---|---|---|---|---|
| 6,502,411 | B1 * | 1/2003 | Okamoto | 62/129 |
| 6,526,766 | B1 * | 3/2003 | Hiraoka et al. | 62/125 |
| 6,584,786 | B1 * | 7/2003 | Tavolazzi | 62/125 |
| 6,786,058 | B1 * | 9/2004 | Sanna | 62/229 |

* cited by examiner

*Primary Examiner*—Marc Norman
(74) *Attorney, Agent, or Firm*—Fleshner & Kim, LLP

(57) ABSTRACT

A networking system for a refrigerator is provided. The networking system includes a main controller for the refrigerator coupled to a first terminal provided on a body portion of the refrigerator, and a second terminal provided on the refrigerator door. The second terminal allows information related to the refrigerator to be input and received, and allows for wireless data exchange between the main controller and the first terminal such that the second terminal to be separated from the refrigerator and still perform such a data exchange. The use of a main controller and first and second terminals allows for increased levels of data storage, and easy access to various types of information.

25 Claims, 5 Drawing Sheets

NETWORKING SYSTEM OF REFRIGERATOR AND METHOD FOR OPERATING THE SAME

This application claims the benefit of the Korean Application Nos. P2003-14897, filed on Mar. 10, 2003, and P2003-14898, filed on Mar. 10, 2003, which are hereby incorporated by reference.

BACKGROUND OF THE INVENTION

1. Field of the Invention

The present invention relates to refrigerator, and more particularly, to networking system of the refrigerator and method for operating the networking system.

2. Background of the Related Art

Recently, according to a trend of refrigerators becoming larger, side-by-side type refrigerators having a home bar and a dispenser become popular. The home bar is provided for taking out food, such as soft drink and beer, from a refrigerating chamber without opening a refrigerator door, and the dispenser is provided for taking out water or ice from the refrigerator without opening the refrigerator door. Moreover, even a monitor may be attached to in place of the home bar for providing information on the refrigerator.

FIG. 1 illustrates a related art side-by-side type refrigerator. As shown in FIG. 1, the refrigerator is provided with a dispenser 5 in one side door 2 of a body 1, and a monitor 10 and a memory (not shown) in the other side door 3. The monitor 10 provides data stored in the memory to a user. However, a size of the memory provided to the door 2 is limited, much data can not be stored therein. According to this, the memory can provide various kinds of information to the user.

SUMMARY OF THE INVENTION

Accordingly, the present invention is directed to networking system of a refrigerator and method for operating the networking system that substantially obviates one or more of the problems due to limitations and disadvantages of the related art.

An object of the present invention is to provide networking system of a refrigerator and method for operating the networking system, which is easy for change of data, and can provide various kinds of information to a user.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the networking system of a refrigerator includes a main controller for the refrigerator, a first terminal configured on a refrigerator body, and a second terminal configured on the refrigerator door, for receiving information on the refrigerator from the main controller, stores the information, and exchanging data with the first terminal by wireless.

The first terminal includes input means for receiving a user's order, output means for providing information to the user, an interface for communication with the second terminal, and a controller for controlling the input means, the output means, and the interface.

The interface includes a compressor for compressing a signal from the input means, modulation means for modulating a signal from the compression board into a signal that can be communicated by wireless, a transmitter for transmitting a signal from the modulating means to the second terminal, a receiver for receiving a compressed data from the second terminal, demodulation means for demodulating the compressed data, and a restoring board for converting the compressed data into a non-compressed data.

The second terminal includes an interface for communication with the first terminal, a memory for storage of a data from the main controller, and a controller for controlling the interface and the memory.

The second terminal exchanges data with an external device, and stores data from the external device. The external device is an ISP server, a transmitter of a broadcasting station, or a home appliance. The second terminal makes communication with the external device through at least one of an ethernet, a modem, a power line, a cable receiver, a TV receiving line, and a settop box.

In other aspect of the present invention, there is provided a method for operating a networking system of a refrigerator including the steps of (a) receiving and storing information on refrigerator from a main controller of the refrigerator in a second terminal in a refrigerator body, receiving and storing a data from an external device in the second terminal, and (b) transmitting the data stored in the second terminal to a first terminal in a refrigerator door by wireless in response to a user's order.

The information on the refrigerator provided from the main controller to the second terminal includes information on temperatures of a freezing chamber and a refrigerating chamber, and information on operation states, and malfunction of different parts.

The method further includes the step of the second terminal uploading an operation history of the refrigerator, or downloading data and programs on the refrigerator, to/from a server of a refrigerator manufacturer. The operation history includes data on power consumption, data on temperature changer, and data on malfunction, of the refrigerator.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
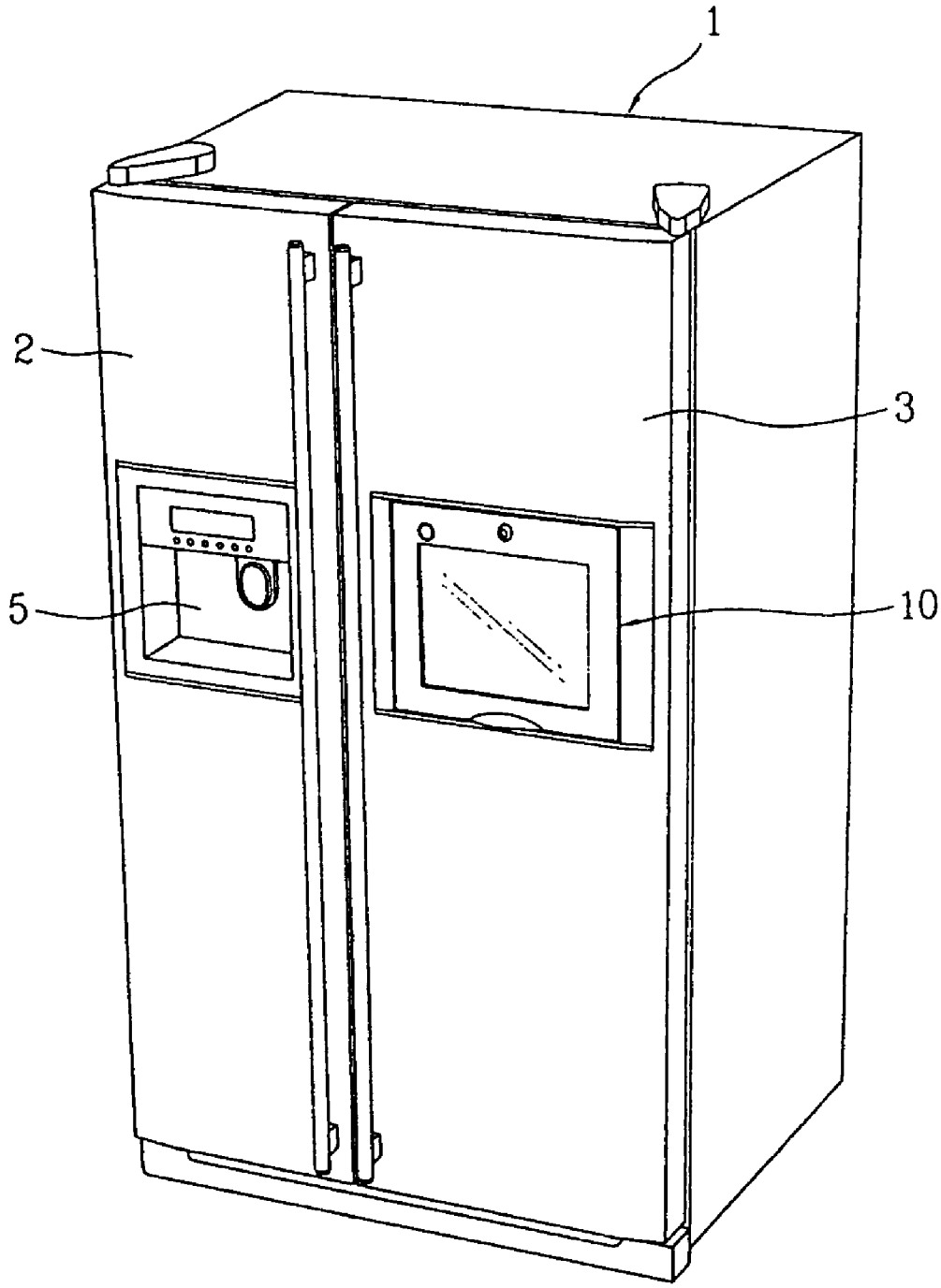
FIG. 1 illustrates a related art side-by-side type refrigerator.
Figure 2:
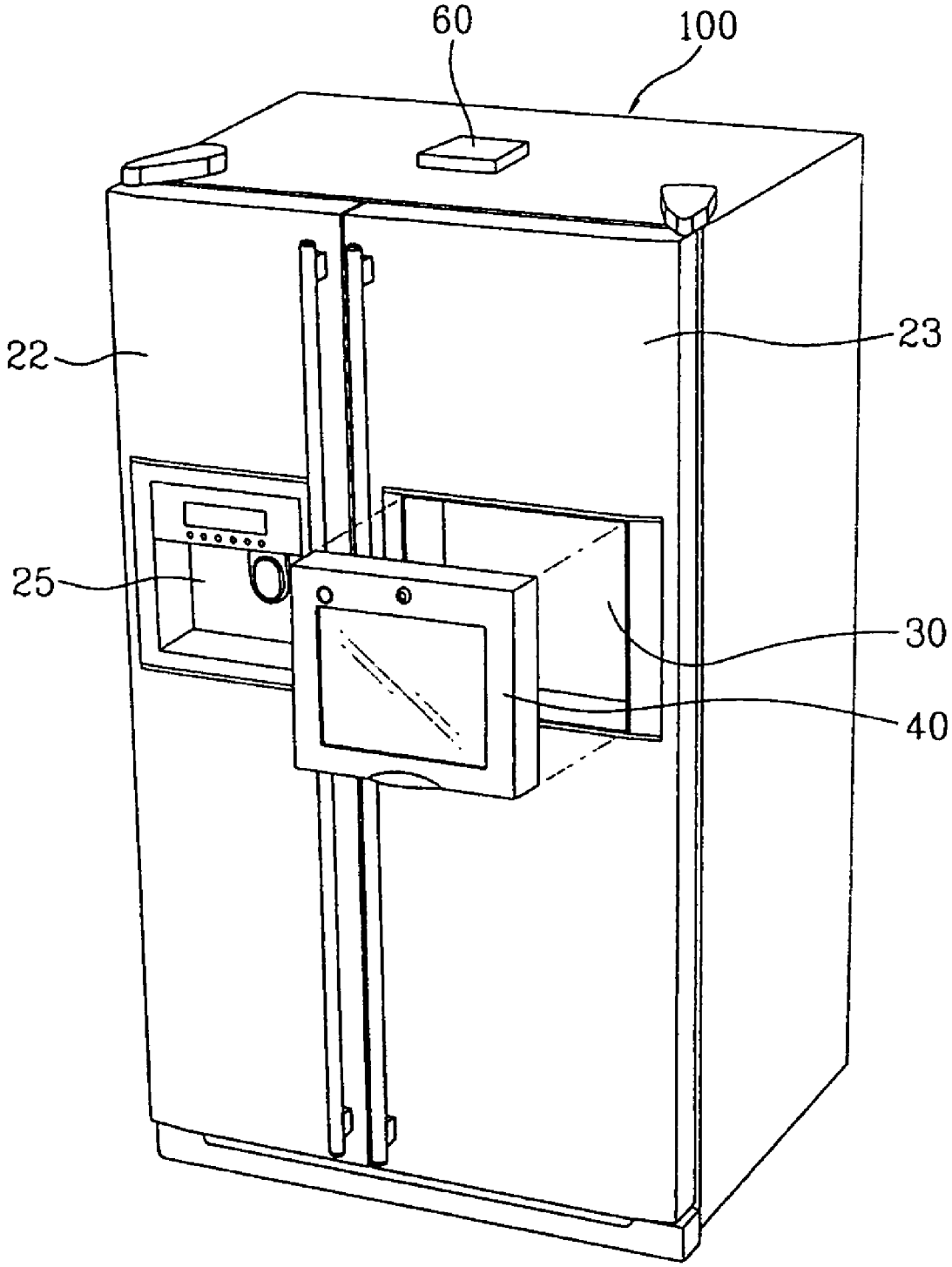
FIG. 2 illustrates a side-by-side type refrigerator in accordance with a preferred embodiment of the present invention.

FIG. 2 illustrates a side-by-side type refrigerator in accordance with a preferred embodiment of the present invention. As shown in FIG. 2, the refrigerator includes a dispenser 25 in one side door 22 of a refrigerator body 100, and a first terminal 40 in the other side door 23. The first terminal 40 is detachably mounted in a hollow 30 in the refrigerator. There is a second terminal 60 on a top surface of the refrigerator body 100. Since the second terminal 60 in FIG. 2 is one embodiment, shape and position of the second terminal 60 are not limited to an illustration in FIG. 2, but can be varied or modified.

Embodiments of the networking system of the refrigerator and the method for operating the networking system of the present invention will be described.

First Embodiment

Figure 3:
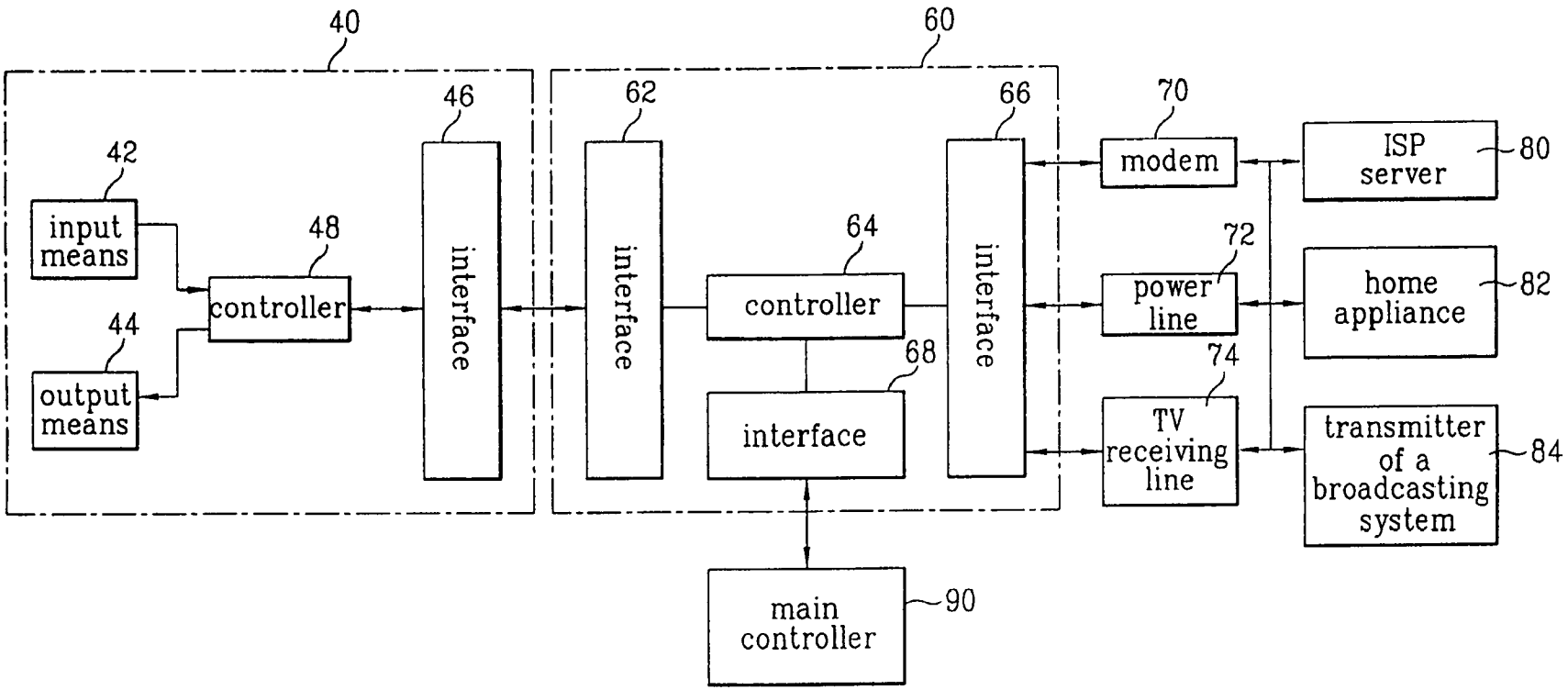
FIG. 3 illustrates a block diagram of a networking system of a refrigerator in accordance with a first preferred embodiment of the present invention.

FIG. 3 illustrates a block diagram of a networking system of a refrigerator in accordance with a first preferred embodiment of the present invention. The networking system of the refrigerator includes a first terminal 40, a second terminal 60, and a main controller 90.

The first terminal receives a user's order, and performs a function for the order. For an example, the first terminal 40 provides a refrigerator user manual to the user following an order of the user, or a data stored in the second terminal 40 to the user. Since the first terminal 40 is detachable from the refrigerator body 100, the first terminal 40 can change or select various functions of the refrigerator at a position spaced from the refrigerator by wireless like a remote controller. For this, the first terminal 40 controls a main controller 90 through the second terminal 60.

The first terminal 40 includes input means 42 for providing a user's order, output means 44 for providing various kinds of information to the user, an interface 46 for wireless communication, and a controller 48 for controlling above units. The input means 42 is at least one of means for receiving the user's order, such as a keyboard, a touch screen, a microphone, a camera, and the output means 44 is, for an example, a screen or a speaker, or the like which can provided information. The interface 46 communicates with the second terminal 60 by using a communication protocol that enables bilateral communication, such as CDMA, or TCP/IP. The interface may be a wireless LAN, or bluetooth. It is apparent that the interface 46 optionally includes amplification means, modulation means, demodulation means, transmission and reception means, antenna, and the like for communication with the second terminal 60. The controller 48 includes a CPU, and memories RAM, ROM. The controller 48 has an emulator or a communication access program, or the like for communication with the second terminal 60 or an external device, and provides a user interface so that the user searches for necessary information, and inputs necessary order.

The second terminal 60 receives data from the main controller 90, and external devices 80, 82, and 84, selectively stores the data, and provides the data to the first terminal 40. For an example, the second terminal 60 receives information on temperatures of a freezing chamber, and the refrigerating chamber from the main controller 90, information on malfunctions of principal parts of the refrigerator, such as a cooling system, and information on operation states of different parts of the refrigerator, makes the information as a data base, and provides the information to the first terminal 40 according to order from the user. Moreover, the second terminal 60 is connected to an ISP server 80 for access to a web page, or receives a broadcasting signal from a transmitter 84 of a broadcasting station, and provides a data from the ISP server 80, and the broadcasting signal from the transmitter 84 of the broadcasting station to the user through the first terminal 40. Also, the second terminal 60 receives information on different home appliances 82, and connected to the home appliances 82 for controlling the home appliances 82. The second terminal 60 grasps on/off and operation states of home appliances 82 in a home, and controls the home appliances 82 according to order of the user. The second terminal 60 may access to a server of a refrigerator manufacturer for uploading an operation history of the refrigerator, or downloading data and programs related to the refrigerator required for the user. The operation history includes data on power consumption, data on temperature change, and data on malfunction of components of the refrigerator.

The second terminal 60 includes interfaces 62, 66, and 68, and a controller 64 for controlling the interfaces 62, 66, and 68. The interface 62 exchanges data with the interface 46 of the first terminal 40 by wireless. The interface 66 is optionally connected to an ethernet line, a modem 70, a power line 72, a cable receiver, a TV receiving line 74, a settop box, and the like, and can exchange data with the ISP server 80, a home network server, the home appliances 82, and the transmitter 84 of the broadcasting station. The interfaces 62, 66, and 68 communicate by using a communication protocol which enables bilateral communication, such as CDMA, or TCP/IP, for an example, a wireless LAN, or bluetooth. It is apparent that the interfaces 62, 66, and 68 optionally include amplification means, modulation means, demodulation means, transmission and reception means, antenna, and the like. The controller 64 includes a CPU, and memories RAM, ROM. The controller 64 has an emulator or a communication access program, or the like stored in a memory for communication with the first terminal 40 or an external device, and stores information on temperatures of the freezing chamber, and the refrigerating chamber, information on malfunctions of principal parts of the refrigerator, and information on operation states of different parts of the refrigerator. The controller 64 performs a function for the user's order from the first terminal 40, or executes a program. The second terminal 60 may be mounted, not on the top surface, but a side surface of the body 100, or an inside of the body 100, or detached from the body 100. The second terminal may be 60 may be a settop box, a home network server, or a PC which can make wire/wireless communication.

The main controller 90 senses temperatures of, and controls the freezing chamber and refrigerating chamber of the refrigerator, and senses malfunction of the principal parts of the refrigerator, checks operation states of different parts of the refrigerator, and controls different parts of the refrigerator through the first, and second terminals 40, and 60 according to a user's order.

Second Embodiment

Figure 4:
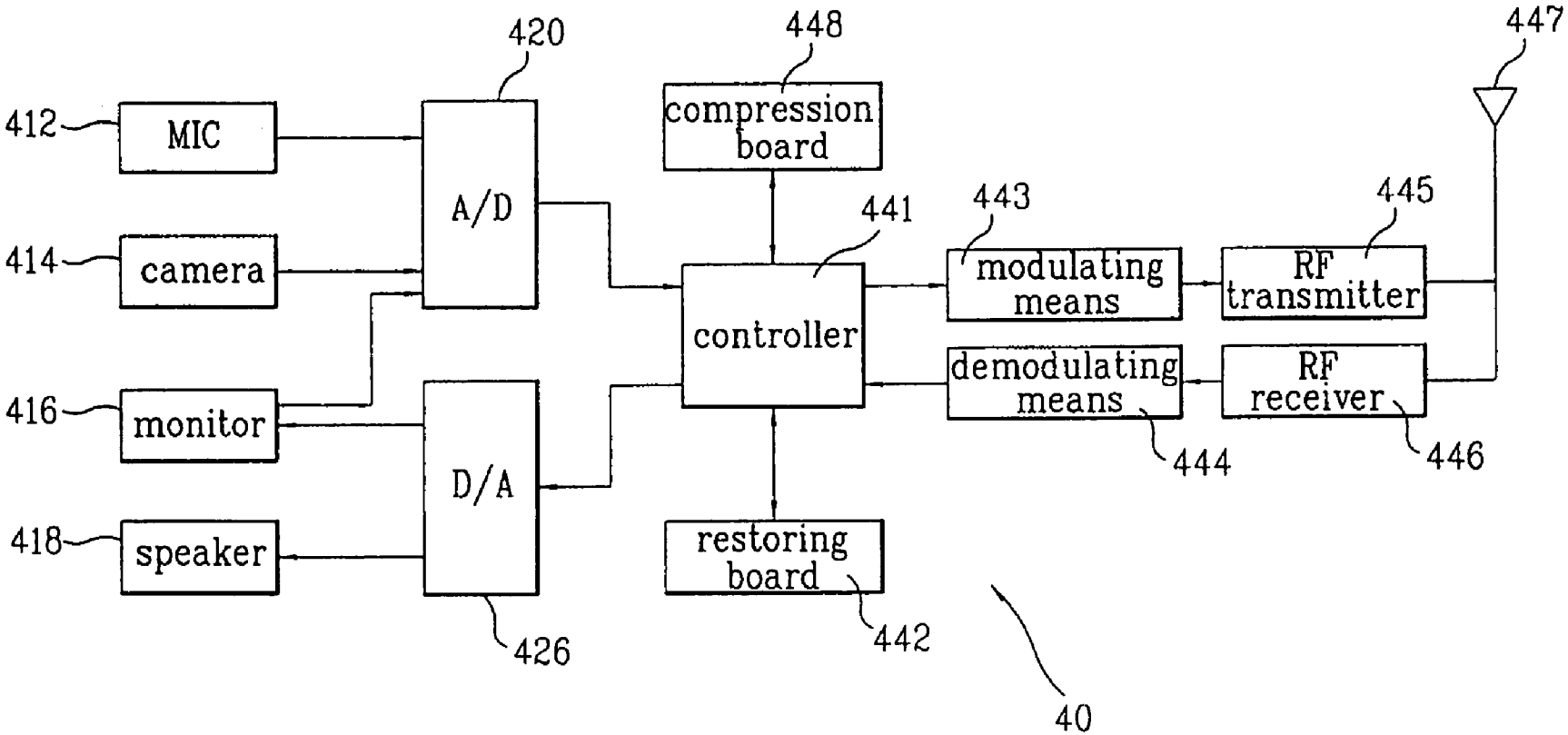
FIGS. 4 and 5 illustrate block diagrams of a networking system of a refrigerator in accordance with a second preferred embodiment of the present invention.
Figure 5:
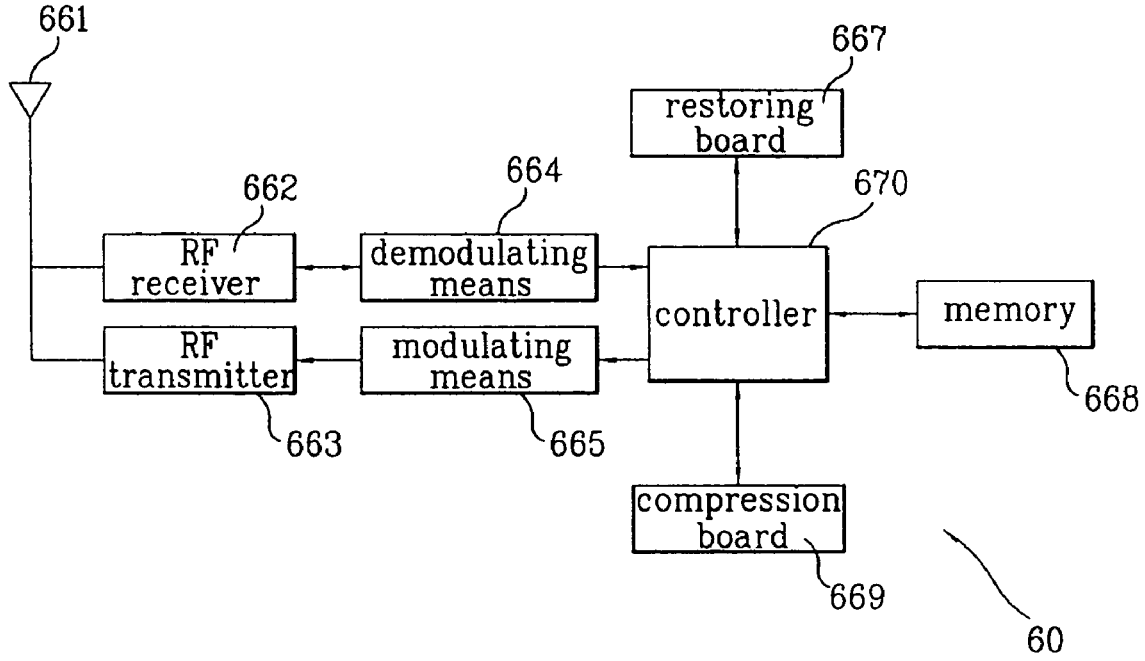

FIGS. 4 and 5 illustrate block diagrams of a first terminal 40 and a second terminal 60 of a networking system of a refrigerator in accordance with a second preferred embodiment of the present invention, respectively.

The first terminal 40 receives a user's order, and performs a function for the user's order. For an example, the first terminal 40 provides a data stored in the second terminal 60 according to the user's order, i.e., an operation history and refrigerator user manual to the user. For this, the controller 441 of the first terminal 40 searches a memory 668 of the second terminal 60 for necessary information, and reads the information, or controls a controller 670 of the second terminal 60 such that the controller 670 provides necessary information thereto. Moreover, since the first terminal 40 is detachable from the refrigerator body 100, the first terminal 40 can change or select different functions of the refrigerator by wireless at a position spaced from the refrigerator like a remote controller. Since the first terminal 40 can write/read data on/from the memory 668 of the second terminal 60, the first terminal 40 can store and read data even if the first terminal 40 has no own memory. Therefore, size and weight of the memory occupies in the first terminal 40 can be reduced.

Referring to FIG. 4, a microphone 412 of the first terminal 40 converts a user's voice and sound into an audio signal, and provided the audio signal to an analog/digital converter 420, and the camera 414 converts an image to a video signal, and provides the video signal to the analog/digital converter 420. The analog/digital converter 420 coverts the audio signal and the video signal into digital signals, and provides the digital signals to the controller 441. The digitized audio signal and video signal are compressed at a compression board 448 by a method the same with the MPEG, and provided to modulation means 443. The compressed data is modulated by the modulation means 443 so that the compressed data can be communicated by wireless. For an example, the compressed data is amplitude modulated, or frequency modulated. The modulated data is transmitted to the second terminal 60 by a RF transmitter 445.

A RF receiver 446 of the first terminal 40 receives the compressed data from the second terminal 60, and provides to a demodulation means 444. The received data is provided to a demodulation means 444. The received data is demodulated by the demodulation means 444, and converted into a non-compressed data by a restoration board 442. Then, the non-compressed data is provided to a digital/analog converter 426 through the controller 441, and analog video signal and audio signal are provided to a monitor 416 and a speaker 418 respectively by the digital/analog converter 426. The monitor 416 and the speaker 418 provide an image and sound to the user, respectively.

The second terminal 60 stores a data from the first terminal 40, for an example, the audio signal, and a video signal, and data from the main controller (not shown) in the body 100, for an example, information on temperatures of the freezing chamber, and the refrigerating chamber, information on malfunctions of principal parts of the refrigerator, information on operation states of different parts of the refrigerator, and operation history of the refrigerator. The operation history includes data on power consumption, data on temperature change, and data on malfunction of components of the refrigerator.

A RF receiver 662 of the second terminal 60 receives the compressed data form the first terminal 40 through the antenna 661, and provides to a demodulation means 664. The received data is demodulated by the demodulation means 664, and converted into a non-compressed data by a restoring board 667. The non-compressed data is stored in a memory 668 through the controller 670.

The compression board 669 of the second terminal 60 converts the non-compressed data stored in the memory 668 to a compressed data, and provides to the controller 670. The controller 670 provides the compressed data to modulation means 665. The compressed data is converted into a signal that can be communicated by wireless at the modulation means 665. The modulated data is transmitted to the first terminal 40 by a RF transmitter 663.

As has been described, the wireless communication between a terminal provided to a refrigerator door and a terminal provided to a refrigerator body permits easy data exchange between the terminals, and to provide various kinds of information to a user regardless of a limitation coming from a memory size of the terminal to the door. Since the terminal provided to the door is detachable, the refrigerator can be controlled at any place in a home by using the terminal.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A networking system for a refrigerator, comprising:

a main controller configured to control a refrigerator;

a first terminal provided on a door of the refrigerator; and a second terminal provided on a body of the refrigerator and configured to receive information related to the refrigerator from the main controller, to store the information, and to perform a wireless data exchange with the first terminal.

2. The networking system as claimed in claim 1, wherein the first terminal includes:

input means for receiving a user's order;

output means for providing information to the user;

an interface for communication with the second terminal; and a controller for controlling the input means, the output means, and the interface.

3. The networking system as claimed in claim 2, wherein the interface includes:

a compressor for compressing a signal from the input means;

modulation means for modulating a signal from the compressor into a signal that can be communicated by wireless;

a transmitter for transmitting a signal from the modulating means to the second terminal;

a receiver for receiving compressed data from the second terminal;

demodulation means for demodulating the compressed data; and a restoring board for converting the compressed data into non-compressed data.

4. The networking system as claimed in claim 1, wherein the first terminal searches the second terminal for data stored therein, and provides the data to the user in response to a user's order.

5. The networking system as claimed in claim 1, wherein the first terminal receives a user's order, and provides the user's order to the main controller through the second terminal.

6. The networking system as claimed in claim 1, wherein the second terminal includes:

an interface for communication with the first terminal;

a memory for storage of data from the main controller; and a controller for controlling the interface and the memory.

7. The networking system as claimed in claim 1, wherein the second terminal exchanges data with an external device, and stores data from the external device.

8. The networking system as claimed in claim 7, wherein the external device is an Internet Service Provided (ISP) server, a transmitter of a broadcasting station, or a home appliance.

9. The networking system as claimed in claim 7, wherein the second terminal communicates with the external device through at least one of an ethernet, a modem, a power line, a cable receiver, a TV receiving line, and a set top box.

10. The networking system as claimed in claim 1, wherein the information related to the refrigerator provided from the main controller to the second terminal includes:

information related to temperatures of a freezing chamber and a refrigerating chamber of the refrigerator; and information related to operation states and malfunction of a plurality of parts of the refrigerator.

11. The networking system as claimed in claim 1, wherein the second terminal uploads an operation history of the refrigerator, and downloads data and programs related to the refrigerator to/from a server of a refrigerator manufacturer.

12. The networking system as claimed in claim 11, wherein the operation history includes data on power consumption data on temperature changes, and data on malfunction of the refrigerator.

13. A method for operating a networking system of a refrigerator, comprising:

(a) receiving and storing information related to a refrigerator from a main controller of the refrigerator by a second terminal on a refrigerator body, and receiving and storing data from an external device in the second terminal; and (b) transmitting the information and data stored in the second terminal to a first terminal on a door of the refrigerator by wireless communication in response to a user's order.

14. The method as claimed in claim 13, wherein the information related to the refrigerator provided from the main controller to the second terminal includes:

information related to temperatures of a freezing chamber and a refrigerating chamber, and information related to operation states, and malfunction of different parts.

15. The method as claimed in claim 13, wherein the external device is an Internet Service Provided (ISP) server, a transmitter of a broadcasting station, or a home appliance.

16. The method as claimed in claim 13, wherein the second terminal communicates with the external device through at least one of an ethernet, a modem, a power line, a cable receiver, a TV receiving line, and a set top box.

17. The method as claimed in claim 13, further comprising the second terminal uploading an operation history of the refrigerator, or downloading data and programs on the refrigerator, to/from a server of a refrigerator manufacturer.

18. The method as claimed in claim 17, wherein the operation history includes data related to power consumption, data related to temperature changes, and data related to malfunction of the refrigerator.

19. The method as claimed in claim 13, further comprising searching the second terminal for data stored therein in response to a user's order.

20. A method for operating a networking system of a home appliance, comprising:

receiving information related to an appliance from a main controller of the appliance, and storing the information in a first terminal provided on a main body of the appliance; and transmitting the information stored in the first terminal to a second terminal provided at a different location than the first terminal, wherein the second terminal is configured to be releasably attached to the refrigerator, and wherein the first and second terminals are configured to perform wireless communication when the second terminal is detached from the appliance.

21. The method of claim 20, wherein receiving information related to an appliance further comprises also receiving data from an external device and storing the data in the terminal provided on the main body of the appliance.

22. The method of claim 20, wherein receiving information related to an appliance comprises receiving information related to operation states of the appliance and malfunction of a plurality of parts of the appliance.

23. The method of claim 20, further comprising uploading an operation history of the appliance to an external server, and downloading data and programs related operation of the appliance from an external server.

24. The method of claim 20, further comprising controlling operation of the appliance through a main controller coupled to the second terminal via the first terminal provided on the main body of the appliance.

25. The method of claim 20, further comprising controlling operation of at least one other appliance coupled to the second terminal via the first terminal provided on the main body of the appliance.

* * * * *